US011101600B2

(12) United States Patent
Lin

(10) Patent No.: US 11,101,600 B2
(45) Date of Patent: Aug. 24, 2021

(54) CONNECTOR MOUNTING MECHANISM

(71) Applicants: Maintek Computer (Suzhou) Co., Ltd, JiangSu (CN); PEGATRON CORPORATION, Taipei (TW)

(72) Inventor: Tien-Ju Lin, Taipei (TW)

(73) Assignees: MAINTEK COMPUTER (SUZHOU) CO., LTD, Jiangsu (CN); PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/919,341

(22) Filed: Jul. 2, 2020

(65) Prior Publication Data

US 2021/0021083 A1 Jan. 21, 2021

(30) Foreign Application Priority Data

Jul. 17, 2019 (CN) ..... 201910646069.4

(51) Int. Cl.
*H01R 13/631* (2006.01)

(52) U.S. Cl.
CPC ..... *H01R 13/631* (2013.01)

(58) Field of Classification Search
CPC ..... H01R 13/631; H01R 43/26
See application file for complete search history.

(56) References Cited

U.S. PATENT DOCUMENTS 6,935,883 B2 * 8/2005 Oddsen, Jr. ..... H01R 13/625 248/274.1
2020/0235522 A1 * 7/2020 Lv ..... H02J 50/90
2021/0021083 A1 * 1/2021 Lin ..... H01R 43/26

FOREIGN PATENT DOCUMENTS

CN 107742803 A 2/2018
CN 207664430 U * 7/2018
CN 207664430 U 7/2018

* cited by examiner

*Primary Examiner* — Abdullah A Riyami
*Assistant Examiner* — Nader J Alhawamdeh
(74) *Attorney, Agent, or Firm* — McClure, Qualey & Rodack, LLP

(57) ABSTRACT

A connector mounting mechanism includes a base, a power module, a guide buffer module, a first position guide block, a first joint guide block, a second position guide block, and a second joint guide block. The first position guide block is connected with the power module and movably received in the guide buffer module. The first joint guide block is disposed on the guide buffer module and connected with the power module, and is configured to fix a first connector. The second joint guide block is disposed at the second position guide block and configured to fix a second connector. The power module drives the first joint guide block to be plugged into the second joint guide block after driving the first position guide block to be guided into the second position guide block.

13 Claims, 12 Drawing Sheets

CONNECTOR MOUNTING MECHANISM

CROSS-REFERENCE TO RELATED APPLICATION

This Non-provisional application claims priority under 35 U.S.C. § 119(a) on Patent Application No(s). 201910646069.4 filed in People's Republic of China on Jul. 17, 2019, the entire contents of which are hereby incorporated by reference.

BACKGROUND

Field of Invention

The present disclosure relates to a connector mounting mechanism, and in particular, to a connector mounting mechanism that can plug the first connector into the second connector precisely.

Description of Related Art

If 3C products in the market need to be connected with other devices, additional connecting wires need to be used. For example, if a notebook computer needs to output an image to an external screen, a high definition multimedia interface (HDMI) adapter needs to be used. Accordingly, transmission quality of the connecting wires is important for the 3C products, and many related manufacturers may have corresponding test machines.

The test on a connecting wire may necessarily rely on the plug and pulling of joints at two ends of the connecting wire. Generally, to avoid the wire falling off unexpectedly during information transmission, the joints at the two ends of the connecting wire may be designed to be clamped very tightly, so that the joints at the two ends may not be easily pulled out. In some test procedures, the plug and pulling of the joints at the two ends still relies on manpower, and even additional processing may be carried out on a joint at one end to make the plug and pulling operation easier. However, this may make the test of the connecting wire not standardized, and the test result may also deviate from the actual situation.

SUMMARY

An objective of the present disclosure is to provide a connector mounting mechanism to improve the prior art.

A connector mounting mechanism according to the present disclosure is configured to plug a first connector into a second connector. The connector mounting mechanism includes a base, a power module, a guide buffer module, a first position guide block, a first joint guide block, a second position guide block, and a second joint guide block. The power module is disposed on the base. The guide buffer module is connected with the power module. The first position guide block is connected with the power module and movably received in the guide buffer module. The first position guide block has a first guide slope. The first joint guide block is disposed on the guide buffer module and connected with the power module. The first joint guide block is configured to fix the first connector. The second position guide block has a second guide slope. The second joint guide block is disposed at the second position guide block and configured to fix the second connector. After the base moves to a preset position, the power module drives the guide buffer module to move so as to drive the first position guide block and the first joint guide block to move. Via the guide of the first guide slope and the second guide slope and the adjustment of the guide buffer module, the first position guide block is guided into the second position guide block. In this case, the power module drives the first joint guide block to be plugged into the second joint guide block so as to allow the first connector to be plugged into the second connector.

According to one or more implementations of the present disclosure, the power module of the connector mounting mechanism may be a cylinder module.

According to one or more implementations of the present disclosure, the base of the connector mounting mechanism may include a first axial positioning mechanism, a second axial positioning mechanism, and a third axial positioning mechanism. The first axial positioning mechanism, the second axial positioning mechanism, and the third axial positioning mechanism may be perpendicular to and mechanically connected with each other.

According to one or more implementations of the present disclosure, the guide buffer module of the connector mounting mechanism may include a first rail assembly and a second rail assembly. Sliding directions of the first rail assembly and the second rail assembly may be perpendicular to each other.

According to one or more implementations of the present disclosure, the second rail assembly of the connector mounting mechanism may be connected with the first rail assembly. The first position guide block may be connected with the second rail assembly.

According to one or more implementations of the present disclosure, the first rail assembly may include a first linear rail and a group of first springs. The second rail assembly may include a second linear rail and a second spring. The second rail assembly may be movably disposed on the first linear rail via the group of first spring. The first position guide block may be movably disposed on the second linear rail via the second spring.

According to one or more implementations of the present disclosure, in the connector mounting mechanism, the first rail assembly may further include a first rail platform. The second rail assembly may further include a second rail platform and a support plate protruding from the second rail platform. The first linear rail may be located on the first rail platform. The second rail platform may be connected with the group of first springs thus to be movably disposed on the first linear rail. The second linear rail may be located on the second rail platform.

According to one or more implementations of the present disclosure, the second spring may be connected with the first position guide block and the support plate.

According to one or more implementations of the present disclosure, the second rail assembly may further include a slider. The second spring may be disposed on the slider.

According to one or more implementations of the present disclosure, the guide buffer module of the connector mounting mechanism may have a housing disposed on the first position guide block and have an opening. The first joint guide block may be disposed on the housing. The first position guide block may protrude from the opening to expose the first guide slope. The first position guide block may have a freedom degree of movement along a direction of the opening.

According to one or more implementations of the present disclosure, the first joint guide block of the connector mounting mechanism may further have a groove and a first joint fixing block. The first connector may be received in the groove, and the first joint fixing block may cover the first connector, so that the first connector is fixedly received in the first joint guide block.

According to one or more implementations of the present disclosure, the second joint guide block of the connector mounting mechanism may have a joint guide groove having a joint guide slope and connected with the second connector. The joint guide slope may be next to the second connector.

According to one or more implementations of the present disclosure, when the power module of the connector mounting mechanism drives the first position guide block to be guided into the second position guide block, the first guide slope may be partly in contact with and attached to the second guide slope.

According to one or more implementations of the present disclosure, the connector mounting mechanism in the present disclosure is configured to plug the first connector into the second connector. After a position of the second connector is fixed, the first connector is roughly positioned at the second connector via the base. A position of the first connector is adjusted finely and guided via a coupling between the first position guide block and the second position guide block. Due to the guide buffer module, the coupling positioning of the first position guide block and the second position guide block may be automatic and flexible. The first connector can be plugged into the second connector via the guide of the first joint guide block and the second joint guide block. Accordingly, in the present disclosure, the first connector can be plugged into the second connector normally and smoothly without additional processing on the first connector. In this case, results of corresponding tests on the first connector and the second connector may be more accurate and reasonable. In some actual implementations, the first connector and the second connector may be two joints respectively corresponding to an HDMI. However, the present disclosure is not limited thereto.

These and other features, aspects, and advantages of the present invention will become better understood with regard to the following description, appended claims, and accompanying drawings.

BRIEF DESCRIPTION OF THE DRAWINGS

FIG. 8 to FIG. 10 are top views following FIG. 7 showing a procedure of plugging the first connector into the second connector via the connector mounting mechanism according to the embodiments of the present disclosure, wherein

DETAILED DESCRIPTION

Embodiments are given below in detail with reference to the accompanying drawings, but the embodiments provided are not intended to limit the scope of the present disclosure, and the description of a structure operation is not used for limiting the sequence of steps. Any device with equal efficiency produced by a structure recombined by elements is within the scope of the present disclosure. In addition, the accompanying drawings are merely for describing and are not drawn in accordance with the original size. For ease of understanding, the same or similar elements in the description below may be indicated by the same labels.

In addition, for terms used in the entire specification and claims, unless stated particularly, the common meaning of each word used in the field and in the content of the present disclosure and in the particular content is provided. Certain terms used for describing the present disclosure may be discussed below or elsewhere in this specification to provide additional guidance to a person skilled in the art on description of the present disclosure.

In the implementation and claims, "a" and "the" may broadly mean one or more unless otherwise particularly defined. The numbers used in the steps are only used for marking the steps for illustration, and are not intended to limit the sequence and implementations.

Figure 1:
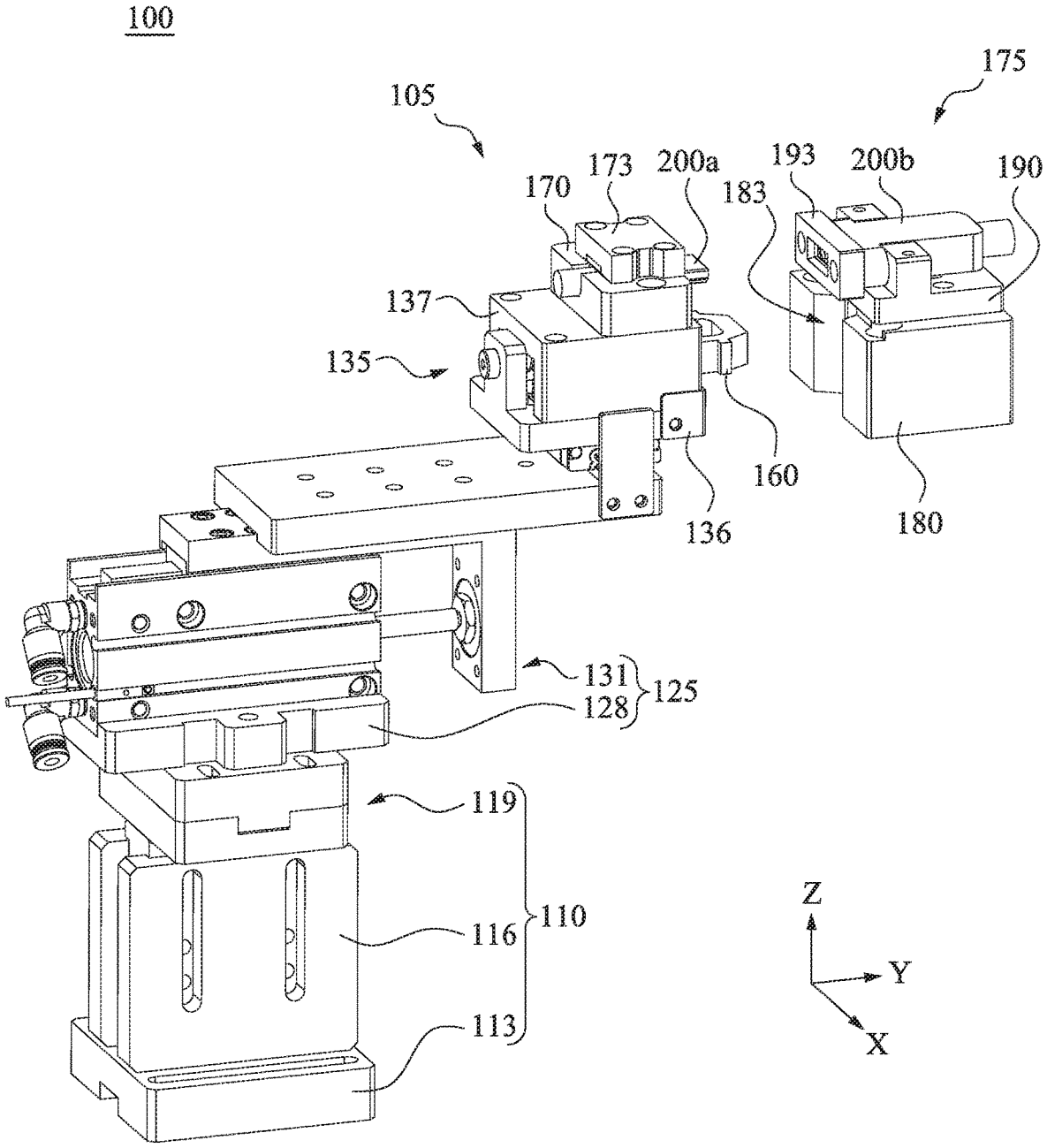
FIG. 1 is a three-dimensional diagram of a connector mounting mechanism according to an embodiment of the present disclosure.

FIG. 1 is a three-dimensional diagram of a connector mounting mechanism 100 according to an embodiment of the present disclosure. In FIG. 1, the connector mounting mechanism 100 according to the present disclosure is configured to plug a first connector 200*a* into a second connector 200*b*. The first connector 200*a* is received in a first connector plug module 105 of the connector mounting mechanism 100, and the second connector 200*b* is fixed at a second connector plug module 175 of the connector mounting mechanism 100. In this implementation, during the first connector 200*a* is plugged into the second connector 200*b*, the second connector plug module 175 remains motionless, and the second connector 200*b* received in the second connector plug module 175 also remains motionless. After the first connector 200*a* is positioned to be aligned with the second connector 200*b*, the first connector 200*a* is plugged into the second connector 200*b* via a power module of the first connector plug module 105. In this implementation, the power module is a cylinder module 125. In this implementation, the first connector 200*a* and the second connector 200*b* are two joints respectively corresponding to an HDMI. However, the present disclosure is not limited thereto.

Figure 2:
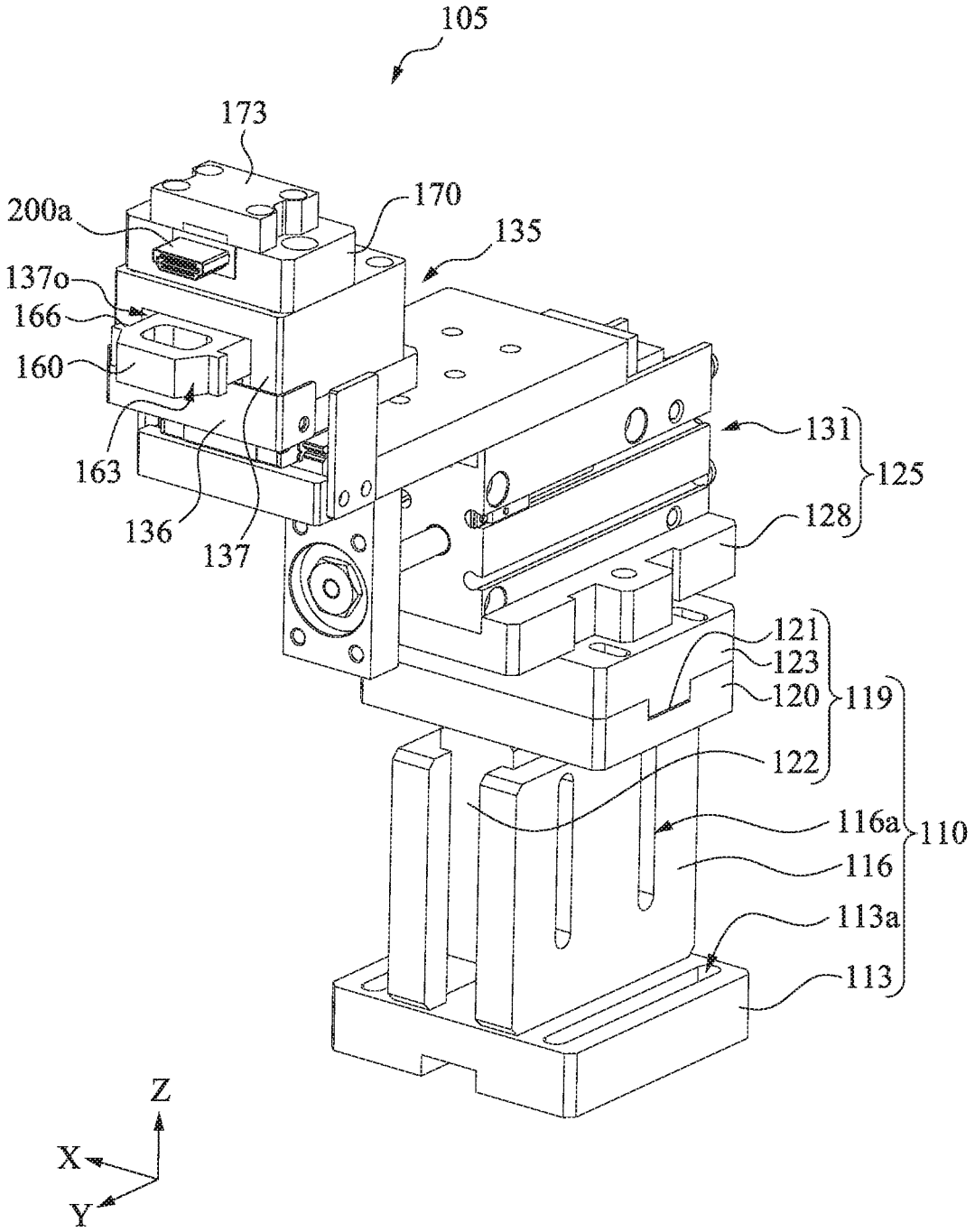
FIG. 2 is a three-dimensional diagram of a first connector plug module of the connector mounting mechanism in FIG. 1 in another angle of view.

FIG. 2 is a three-dimensional diagram of a first connector plug module 105 of the connector mounting mechanism 100 in FIG. 1 in another angle of view. Please refer to FIG. 1 and FIG. 2 together. The first connector plug module 105 includes a base 110, a cylinder module 125, a first position guide block 160, a guide buffer module 135, and a first joint guide block 170. The first connector 200*a* is received in the first joint guide block 170. In detail, in this implementation, the cylinder module 125 is directly disposed on the base 110. The guide buffer module 135 is connected with the cylinder module 125 and receives the first position guide block 160. The guide buffer module 135 has a housing 136 and a housing 137. The housing 137 has an opening 137*o*. The first position guide block 160 is partly received in the housing 136 and the housing 137. The first position guide block 160 has a first guide slope 163 and a protruding member 166, and the first position guide block 160 protrudes from the opening 137*o*. Accordingly, the first guide slope 163 and the protruding member 166 are both located outside of the housing 136 and the housing 137 to be exposed. The first joint guide block 170 is directly disposed on the guide buffer module 135 thus to be connected with the first position guide block 160, and is connected with the cylinder module 125. The first joint guide block 170 has a groove and a first joint fixing block 173, and the first connector 200*a* is disposed in the groove of the first joint guide block 170. The first joint fixing block 173 is disposed above the first joint guide block 170 to cover the first connector 200*a*, and is fixed on the first joint guide block 170 via a screw hole on the first joint fixing block 173, so that the first connector 200*a* is fixedly received in the first joint guide block 170. It should be understood that it is merely an embodiment, and the fixing methods of the first connector 200*a* should not be limited thereto.

Figure 3:
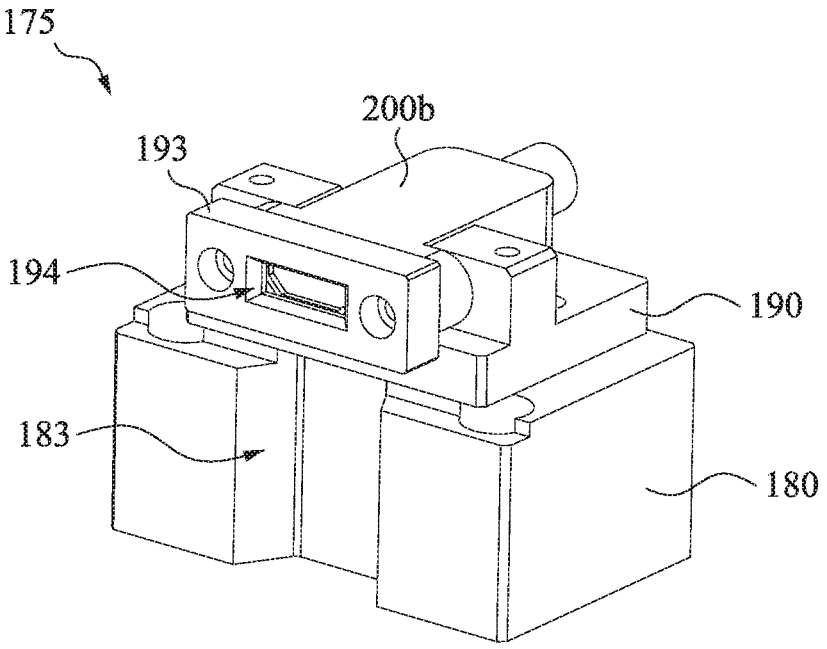
FIG. 3 is a three-dimensional diagram of a second connector plug module of the connector mounting mechanism in FIG. 1.

FIG. 3 is a three-dimensional diagram of a second connector plug module 175 of the connector mounting mechanism 100 in FIG. 1. In FIG. 3, the second connector plug module 175 includes a second position guide block 180 and a second joint guide block 190. In this implementation, the second joint guide block 190 is directly disposed on the second position guide block 180, and the second joint guide block 190 further has a fixed bracket. The second connector 200*b* is received in the fixed bracket of the second joint guide block 190.

Go back to FIG. 2. In the present disclosure, the base 110 is configured to roughly position the first connector 200*a* to allow the first connector 200*a* to be roughly aligned with the second connector 200*b* in three axial directions X, Y, and Z in the space. In this implementation, the base 110 includes a first axial positioning mechanism 113, a group of second axial positioning mechanisms 116, and a third axial positioning mechanism 119 which are respectively configured to position the first connector 200*a* in the corresponding Y direction, Z direction, and X direction. Accordingly, the first axial positioning mechanism 113, the second axial positioning mechanisms 116, and the third axial positioning mechanism 119 are disposed perpendicularly to each other and are mechanically connected with each other. In detail, the second axial positioning mechanisms 116 are disposed on the first axial positioning mechanism 113, and the third axial positioning mechanism 119 is disposed on the second axial positioning mechanism 116 and includes a first platform 120 and a second platform 123. The first platform 120 is provided with a support member 122 and a positioning groove 121. The second platform 123 is disposed on the first platform 120 and is slidably clamped in the positioning groove 121. Other elements of the first connector plug module 105, such as the cylinder module 125, the first position guide block 160, the guide buffer module 135, and the first joint guide block 170, are all disposed on the second platform 123, and the detailed may be described below.

In FIG. 2, in this implementation, the first axial positioning mechanism 113 is a rectangular substrate, and has a long-strip elliptical positioning round groove 113*a*, and a length direction of the long-strip elliptical positioning round groove 113*a* extends in the Y direction. Accordingly, the second axial positioning mechanism 116 can be mechanically disposed on different positions of the positioning round groove 113*a* according to different requirements, so as to adjust the position of the first connector 200*a* in the Y direction. The second axial positioning mechanism 116 includes two rectangular substrates, and the two rectangular substrates are respectively disposed in the positioning round groove 113*a*, and are located at the same Y direction. The second axial positioning mechanism 116 also has a long-strip elliptical positioning round groove 116*a*, and a length direction of the positioning round groove 116*a* extends in the Z direction. Similarly, the support member 122 of the third axial positioning mechanism 119 can be mechanically disposed on different positions of the positioning round groove 116*a* according to requirements, so as to adjust the position of the first connector 200*a* in the Z direction. The first platform 120 of the third axial positioning mechanism 119 is disposed on the second axial positioning mechanism 116 via the support member 122. The first platform 120 is provided with a long-strip positioning groove 121, and a length direction of the positioning groove 121 extends in the X direction. The third axial positioning mechanism 119 is further provided with a second platform 123. The second platform 123 is clamped at different positions of the positioning groove 121 according to requirements, so as to adjust the position of the first connector 200*a* in the X direction. In this way, the first connector 200*a* is roughly positioned in three axial directions X, Y, and Z in the first step via the base 110, so that the first connector 200*a* can be roughly aligned with the second connector 200*b* in the three axial directions X, Y, and Z. Correspondingly, the first position guide block 160 is roughly aligned with the second position guide block 180. At the same time, the first joint guide block 170 is roughly aligned with the second position guide block 180. It should be understood that the structure of the base 110 is merely used as an embodiment of the base of the present disclosure. However, the disclosure is not limited thereto. Other base designs that can position the first connector 200*a* in the space are also included in the present disclosure. However, in some implementations, the base 110 can be disposed automatically by a computer. In this implementation, after completing the first step of rough positioning, a difference between a center of the first connector 200*a* and a center of the second connector 200*b* in the X direction and a difference between the center of the first connector 200*a* and the center of the second connector 200*b* in the Z direction are both less than 1 mm.

Go back to FIG. 2. The cylinder module 125 is directly disposed on the second platform 123 of the third axial positioning mechanism 119. In FIG. 2, the cylinder module 125 includes a platform 128 and a drive member 131. The platform 128 is connected with the second platform 123. The drive member 131 is disposed on the platform 128, and is connected with the guide buffer module 135. The first position guide block 160 is received in the guide buffer module 135. The first joint guide block 170 is directly disposed on the guide buffer module 135 and receives the first connector 200*a*. After the first connector 200*a* is roughly aligned with the second connector 200*b*, the drive member 131 of the cylinder module 125 drives the guide buffer module 135 disposed thereon, so that the first position guide block 160 received in the guide buffer module 135 drives the first joint guide block 170 on the guide buffer module 135 synchronously to allow the first connector 200*a* received in the first joint guide block 170 to approach the second connector 200*b* along the Y direction. In some actual situations, since the 3C products are used by persons, in the present disclosure, the power module chooses the cylinder module 125 to simulate the strength and speed of a person plugging or pulling the first connector 200*a* into or out of the second connector 200*b* which can be controlled by adjusting a valve pressure and a drive speed of the cylinder module 125.

FIG. 3 is a three-dimensional diagram of a second connector plug module 175 of the connector mounting mechanism 100 in FIG. 1. The second connector plug module 175 includes a second position guide block 180 and a second joint guide block 190. The second connector 200*b* is received in the second joint guide block 190. The second position guide block 180 has a second guide slope 183.

Please refer to FIG. 2 and FIG. 3 together. The connector mounting mechanism 100 according to the present disclosure guides the first joint guide block 170 and the second joint guide block 190 to be positioned via a flexible coupling between the first position guide block 160 and the second position guide block 180, so that the received first connector 200*a* can be plugged into the second connector 200*b*.

However, in this implementation in FIG. 3, the second joint guide block 190 is further provided with a joint guide groove 193 having a joint guide slope 194. The joint guide groove 193 is directly connected with the second connector 200*b*, and the joint guide slope 194 is next to the second connector 200*b*. During the first connector 200*a* is plugged into the second connector 200*b*, the first connector 200*a* can be flexibly plugged into the second connector 200*b* via the guide of the joint guide slope 194. Details are described below.

Figure 4:
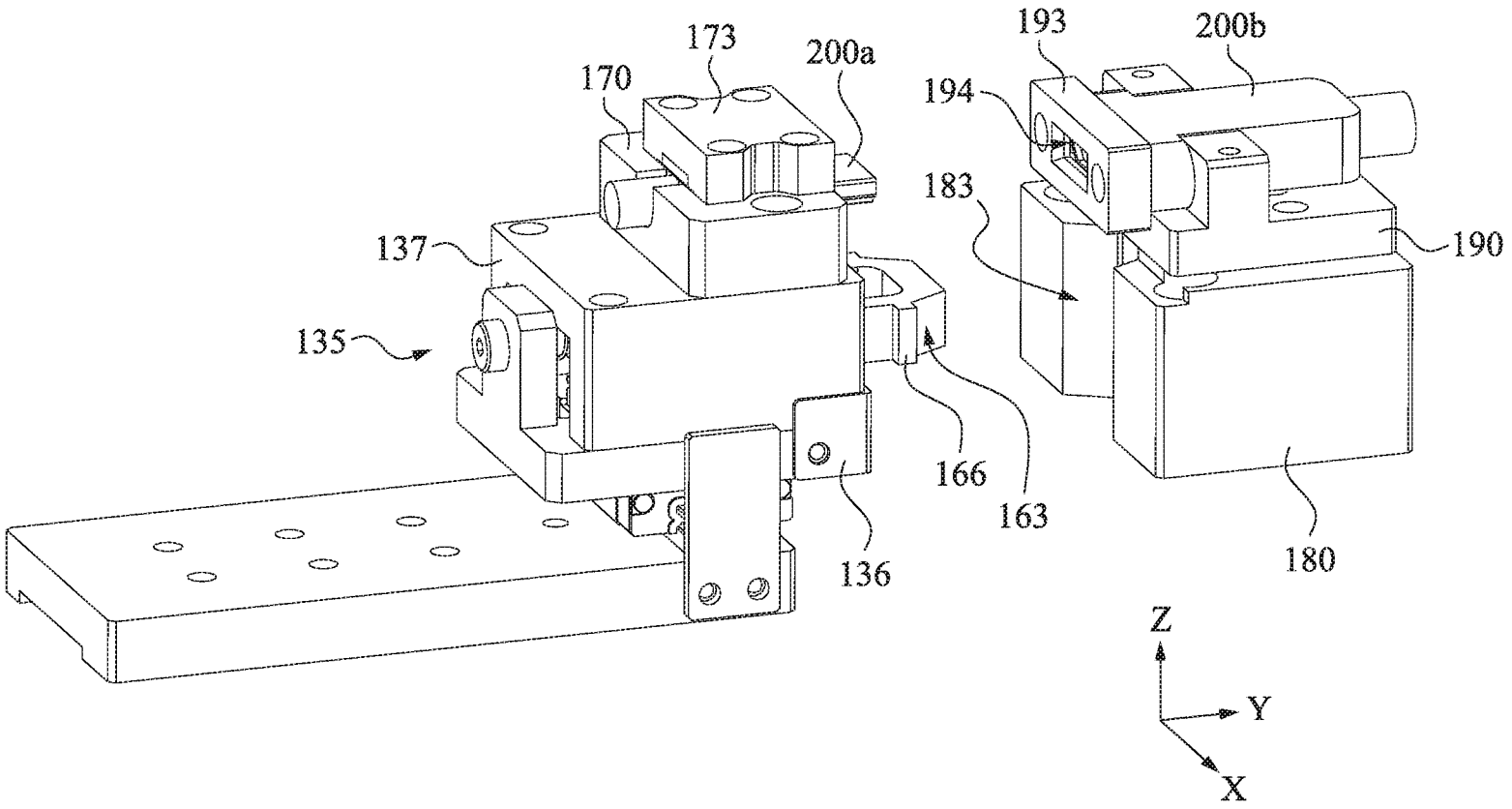
FIG. 4 is a partial enlarged diagram of FIG. 1.

When the base 110 allows the first connector 200*a* to be roughly aligned with the second connector 200*b*, the first position guide block 160 is also allowed to be roughly aligned with the second position guide block 180, and the first joint guide block 170 is also roughly aligned with the second position guide block 180. FIG. 4 is a partial enlarged diagram of FIG. 1, and the base 110 and the cylinder module 125 are omitted to more clearly show the first connector plug module 105, the second connector plug module 175, and the driving direction of the cylinder module 125. Please refer to FIG. 3 and FIG. 4 together. In this implementation, the first position guide block 160 is a protruding block and has a first guide slope 163; the second position guide block 180 is a recessed block and has a second guide slope 183 which is a concave surface. During the drive member 131 of the cylinder module 125 pushes the first connector 200*a* to approach the second connector 200*b* along the Y direction, the first position guide block 160 approaches the second position guide block 180, and the first guide slope 163 comes into contact with the second guide slope 183, so as to flexibly allow the first position guide block 160 to be gradually guided into the second position guide block 180. Since the first joint guide block 170 is connected via the guide buffer module 135, when the first position guide block 160 is guided into the second position guide block 180, the first position guide block 160 guides the first joint guide block 170 to be plugged into the second joint guide block 190 accordingly, so that the first connector 200*a* received in the first joint guide block 170 is plugged into the second connector 200*b*. However, in this implementation, the first guide slope 163 and the second guide slope 183 have a same slope angle, and therefore after the first connector 200*a* is completely plugged into the second connector 200*b*, the first guide slope 163 and the second guide slope 183 can be roughly attached to each other.

Figure 5:
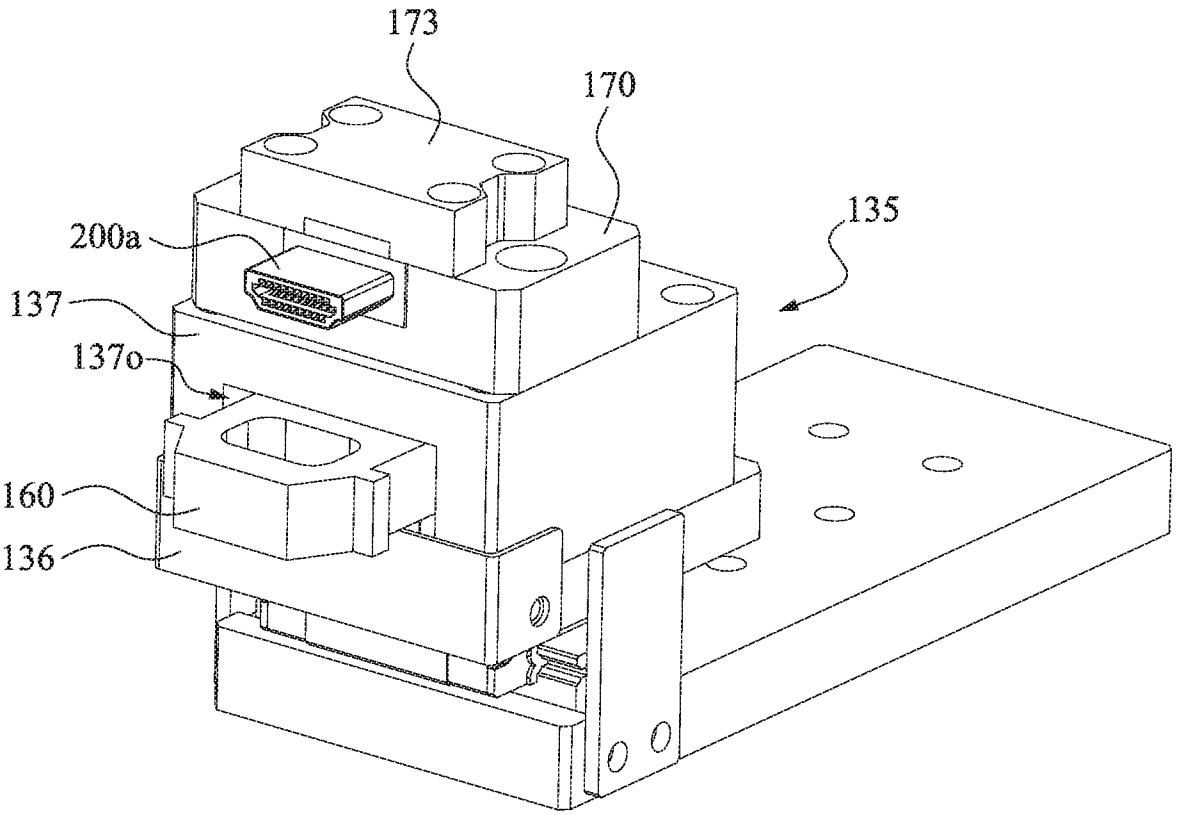
FIG. 5 is a partial enlarged diagram of FIG. 2 where some elements are omitted.

FIG. 5 is a partial enlarged diagram of a first connector plug module 105 of FIG. 2 to further describe the structure disposed on the cylinder module 125. The guide buffer module 135 is disposed on the drive member 131 of the cylinder module 125, and the guide buffer module 135 receives the first position guide block 160. The first joint guide block 170 receiving the first connector 200*a* is directly disposed on the guide buffer module 135. However, in this implementation, the first position guide block 160 is movably received in the guide buffer module 135, and is protected by the housing 136 and the housing 137 in FIG. 5. However, the first guide slope 163 and the protruding member 166 of the first position guide block 160 protrude from the opening 137*o*, and run through the opening 137*o*. The first position guide block 160 has a freedom degree of movement along a direction of the opening 137*o* (i.e., the Y direction). For details, reference may be made to the following description of the specific structure of the guide buffer module 135.

Figure 6A:
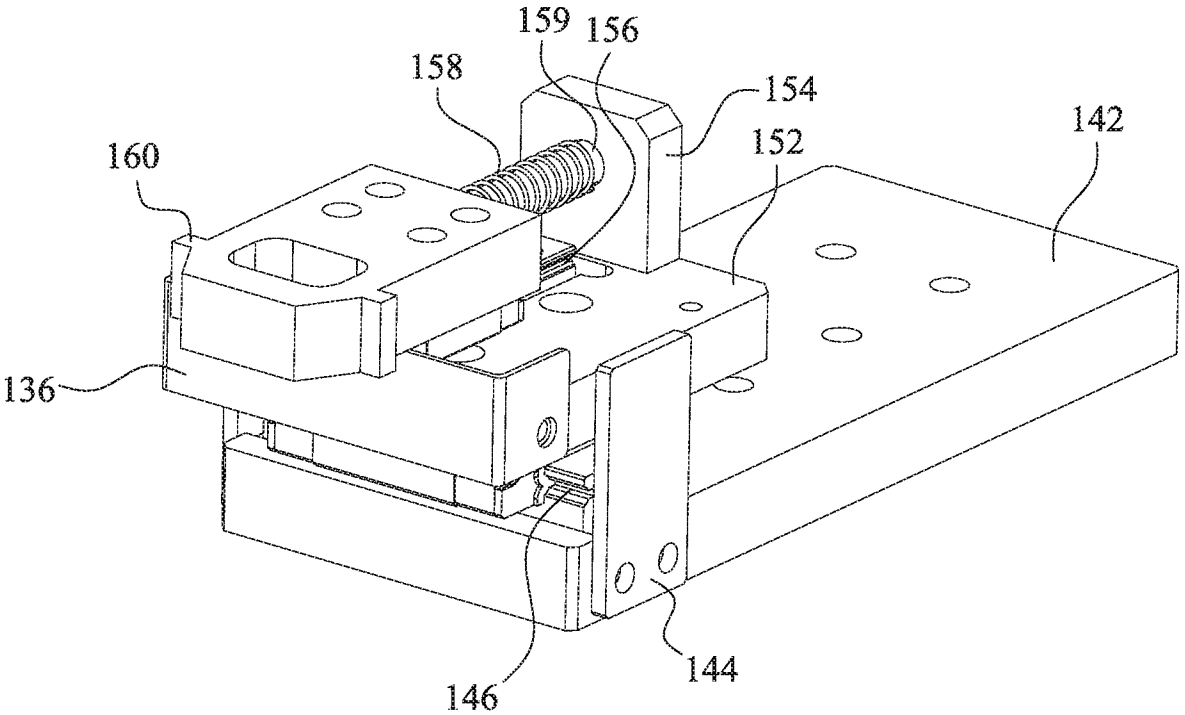
FIG. 6A is a schematic diagram of an internal structure of FIG. 5 where some elements are omitted.
Figure 6C:
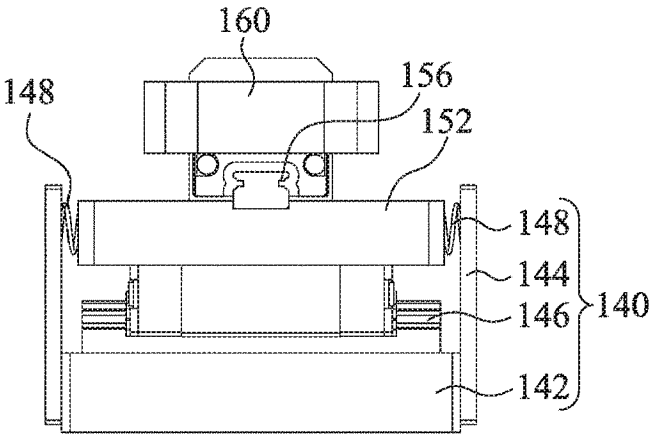
FIG. 6C is a front view of FIG. 6A.
Figure 6B:
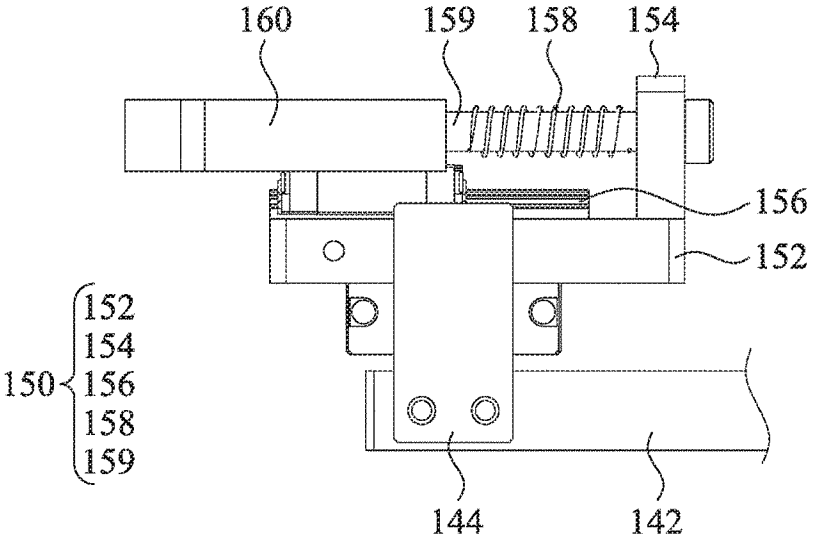
FIG. 6B is a side view of FIG. 6A.

FIG. 6A, FIG. 6B, and FIG. 6C are schematic diagrams of internal structures of FIG. 5 in different angles of view. FIG. 6B is a side view, and FIG. 6C is a front view. To further describe the first position guide block 160, FIG. 6A omits the housing 137 of the guide buffer module 135 and the first joint guide block 170 disposed on the housing 137. FIG. 6B and FIG. 6C further omits the housing 136 compared with FIG. 6A. In FIG. 6A, the guide buffer module 135 further includes a first rail assembly 140 and a second rail assembly 150. Please refer to FIG. 6A and FIG. 6C together. The first rail assembly 140 includes a first rail platform 142, a first linear rail 146, and a group of first springs 148. The first linear rail 146 is disposed on the first rail platform 142, and the first rail platform 142 has a support plate 144. Please refer to FIG. 6A and FIG. 6B together. The second rail assembly 150 includes a second rail platform 152, a second linear rail 156, a second spring 158, and a slider 159. The second linear rail 156 is disposed on the second rail platform 152, and the second rail platform 152 has a protruded support plate 154. In FIG. 6A, the second rail assembly 150 is connected with the first rail assembly 140, and the first position guide block 160 is connected with the second rail assembly 150.

In FIG. 6C, the second rail platform 152 of the second rail assembly 150 is disposed on the first linear rail 146, and is connected with the support plate 144 of the first rail platform 142 via the first springs 148, so that the second rail assembly 150 is movably disposed on the first linear rail 146 via the group of first springs 148. In this way, elements disposed on the second rail platform 152 have a freedom degree of movement along the X direction. However, in FIG. 6B, the first position guide block 160 is disposed on the second linear rail 156, and is coupled with the slider 159, so as to ensure the stability of the first position guide block 160 on the second linear rail 156. However, the first position guide block 160 is connected with the support plate 154 via the second spring 158. In this way, the first position guide block 160 is movably disposed on the second linear rail 156, and the first position guide block 160 has a freedom degree of movement along the Y direction. That is, in this implementation, sliding directions of the first rail assembly 140 and the second rail assembly 150 are perpendicular to each other. Please refer to FIG. 5 together. Corresponding to the freedom degree of movement of the first position guide block 160 along the Y direction, the first position guide block 160 has a freedom degree of movement along a direction of the opening 137*o* of the housing 137. However, in this implementation, the first position guide block 160 is disposed on the guide buffer module 135 via a connection between the first rail assembly 140 and the second rail assembly 150, so that the first position guide block 160 is movably disposed in the guide buffer module 135, and the first position guide block 160 has a small-range freedom degree of movement along the X direction and the Y direction, respectively.

The first position guide block 160 is movably disposed in the guide buffer module 135 thus to achieve automatic guide positioning. For example, in FIG. 4, during the first connector 200*a* is plugged into the second connector 200*b*, when the first position guide block 160 moving along the Y direction has not been aligned with the second position guide block 180, the first connector 200*a* cannot be plugged into the second connector 200*b* smoothly. However, the first position guide block 160 can move within a small range along the X direction and the Y direction. When the first guide slope 163 of the first position guide block 160 comes into contact with the second guide slope 183 and plays a role of guide, the first position guide block 160 can make small-range correction along the X direction and the Y direction via the guide. Via the first springs 148, the second spring 158, and the guide buffer module 135, the positioning of the first position guide block 160 can be further corrected. At the same time, the positioning of the first joint guide block 170 disposed on the guide buffer module 135 can be corrected synchronously, i.e. the guide positioning of the first connector 200*a* in the second step. A more detailed procedure is described below.

Figure 7:
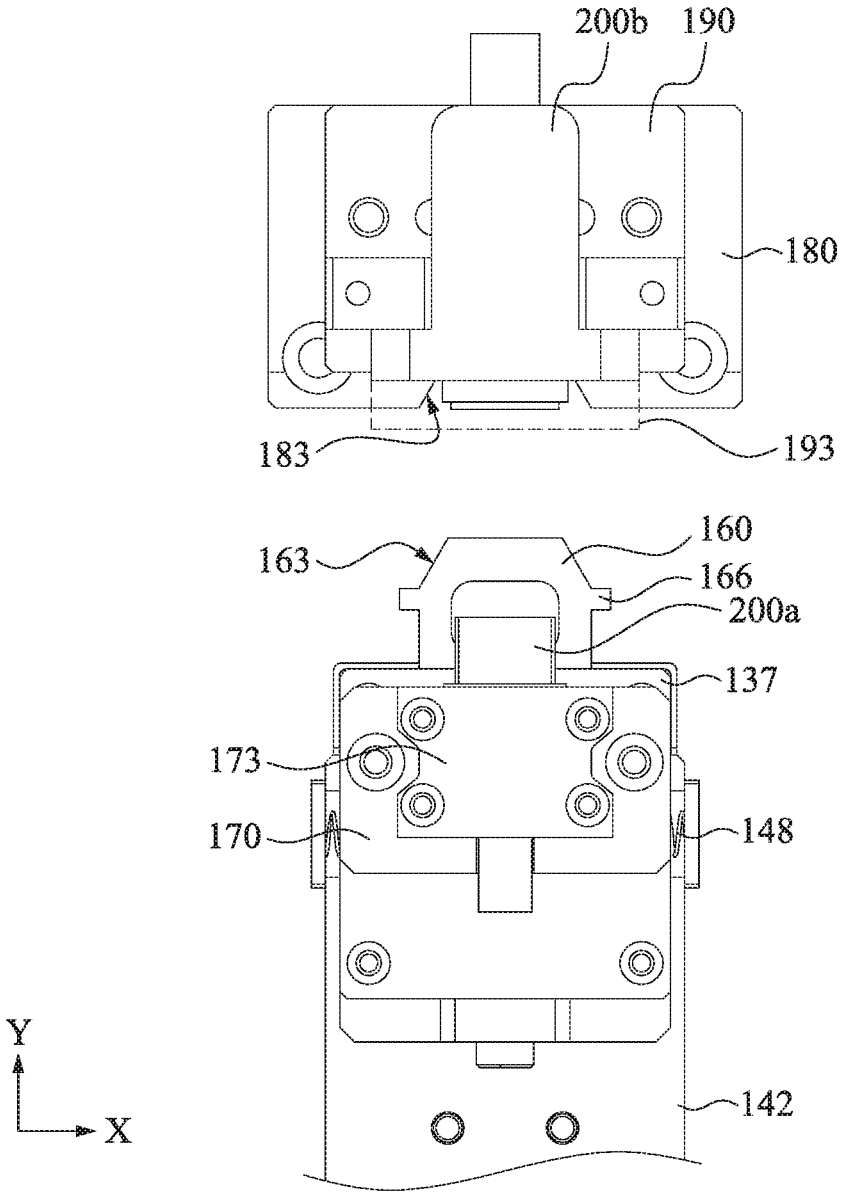
FIG. 7 is a top view of a connector mounting mechanism according to the present disclosure.

FIG. 7 is a top view of the connector mounting mechanism 100 according to the present disclosure to describe the situation that the first connector 200*a* has not been plugged into the second connector 200*b* after the base 110 completes the rough positioning in the first step. To describe the plugging procedure clearly, the joint guide groove 193 is shown by a dotted line, and the joint guide groove 193 is shown by a dotted line for the same reason in FIG. 8, FIG. 9A, and FIG. 10. Please refer to FIG. 4 and FIG. 7 together. Same labels are not described repeatedly. Please refer to FIG. 6B and FIG. 7 together. In FIG. 7, since the first connector 200*a* has not been plugged into the second connector 200*b*, the second spring 158 always applies a force in the Y direction on the first position guide block 160 to allow the first position guide block 160 to approach the second position guide block 180 in FIG. 6B. In this case, in FIG. 7, the first position guide block 160 protrudes from the housing 137 of the guide buffer module 135.

Figure 8:
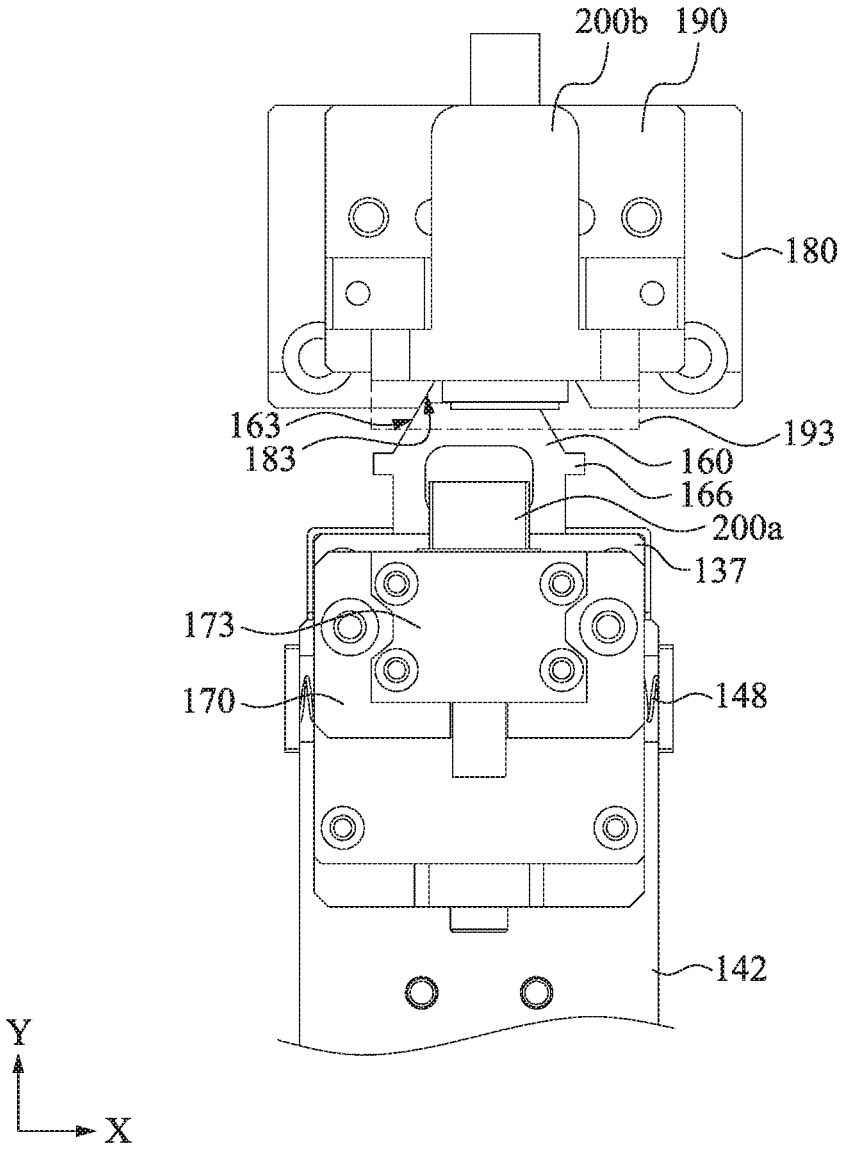

FIG. 8 follows FIG. 7 and shows that the first connector 200*a* keeps approaching the second connector 200*a* and the first connector 200*a* has not been aligned with the second connector 200*a* completely. In this case, the first position guide block 160 protrudes from the guide buffer module 135, so that the first guide slope 163 of the first position guide block 160 may be partly in contact with and attached to the second guide slope 183 of the second position guide block 180 first. Please refer to FIG. 6B and FIG. 8 together. In this implementation, the second spring 158 always applies a force in the Y direction on the first position guide block 160 to allow the first position guide block 160 to approach the second position guide block 180. At the same time, the first joint guide block 170 connected with the first position guide block 160 via the guide buffer module 135 approaches the second joint guide block 190 accordingly. Accordingly, when the first connector 200*a* moves towards the second connector 200*b*, the first guide slope 163 of the first position guide block 160 can keep in contact with the second guide slope 183 of the second position guide block 180. At the same time, the first springs 148 function to allow the first joint guide block 170 disposed on the guide buffer module 135 to automatically correct the position thereof in the X direction, thus driving the first connector 200*a* to be further aligned with the second connector 200*b*.

Figure 9A:
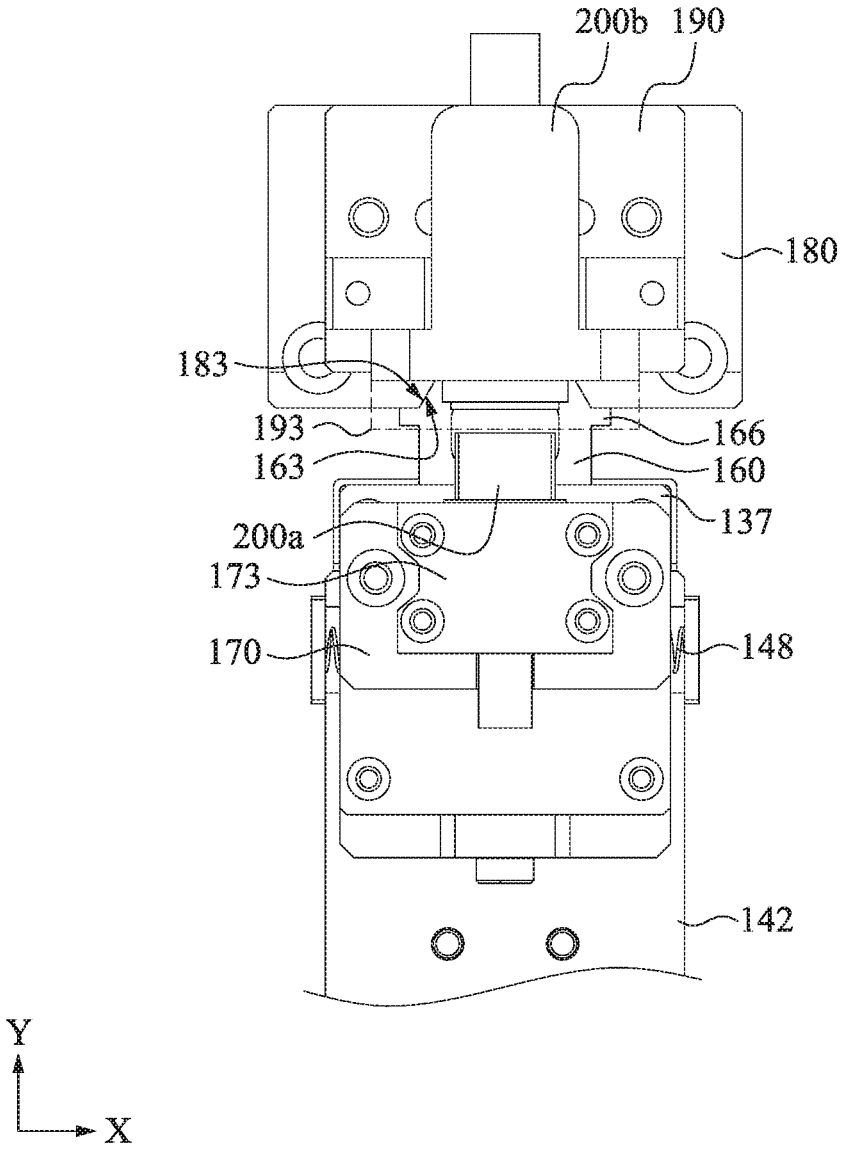

FIG. 9A follows FIG. 8. In this case, the first guide slope 163 of the first position guide block 160 has been completely attached to the second guide slope 183 of the second position guide block 180, and the protruding member 166 of the first position guide block 160 is in contact with the second position guide block 180. Correspondingly, the first joint guide block 170 disposed on the guide buffer module 135 is roughly aligned with the second joint guide block 190 along the X direction. In this case, the drive member 131 of the cylinder module 125 keeps pushing the first connector 200*a* to approach the second connector 200*b* along the Y direction.

Figure 9B:
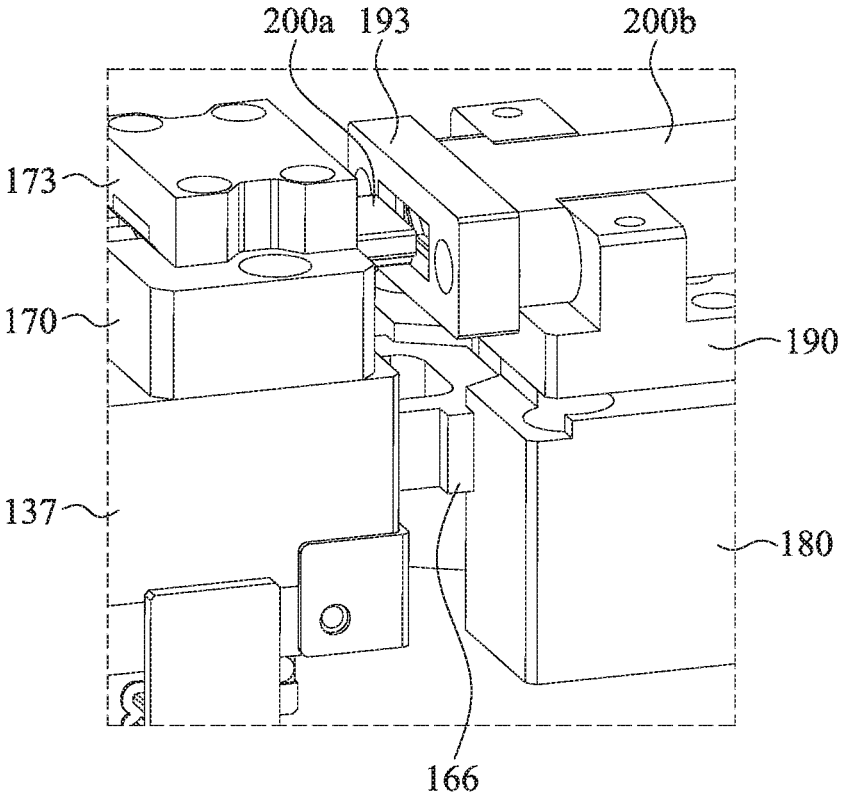
FIG. 9B is a partial enlarged diagram of FIG. 9A in another angle of view.

FIG. 9B is a partial enlarged diagram of FIG. 9A in another angle of view. In FIG. 9B, the protruding member 166 is in contact with the second position guide block 180. Please refer to FIG. 6B together. The elasticity generated by compressing the second spring 158 can completely act on the guide buffer module 135, and the position of the first connector 200*a* received in the first joint guide block 170 is further corrected via the guide buffer module 135. However, in FIG. 9B, via the automatic correction of the guide buffer module 135, the first connector 200*a* has been roughly aligned with the second connector 200*b*. Via the adjustment of the guide buffer module 135 and the guide of the first position guide block 160 and the second position guide block 180, the first connector 200*a* is positioned to be aligned with the second connector 200*b*, i.e. the guide positioning in the second step. Moreover, the positioning precision of the guide positioning in the second step is higher than the rough positioning of the base 110 in the first step. The positioning precision herein refers to differences along the X direction and the Z direction, respectively, between the first connector 200*a* and the second connector 200*b* after the first connector 200*a* is positioned to be aligned with the second connector 200*b*. The less the difference is, the higher the positioning precision is.

Figure 10:
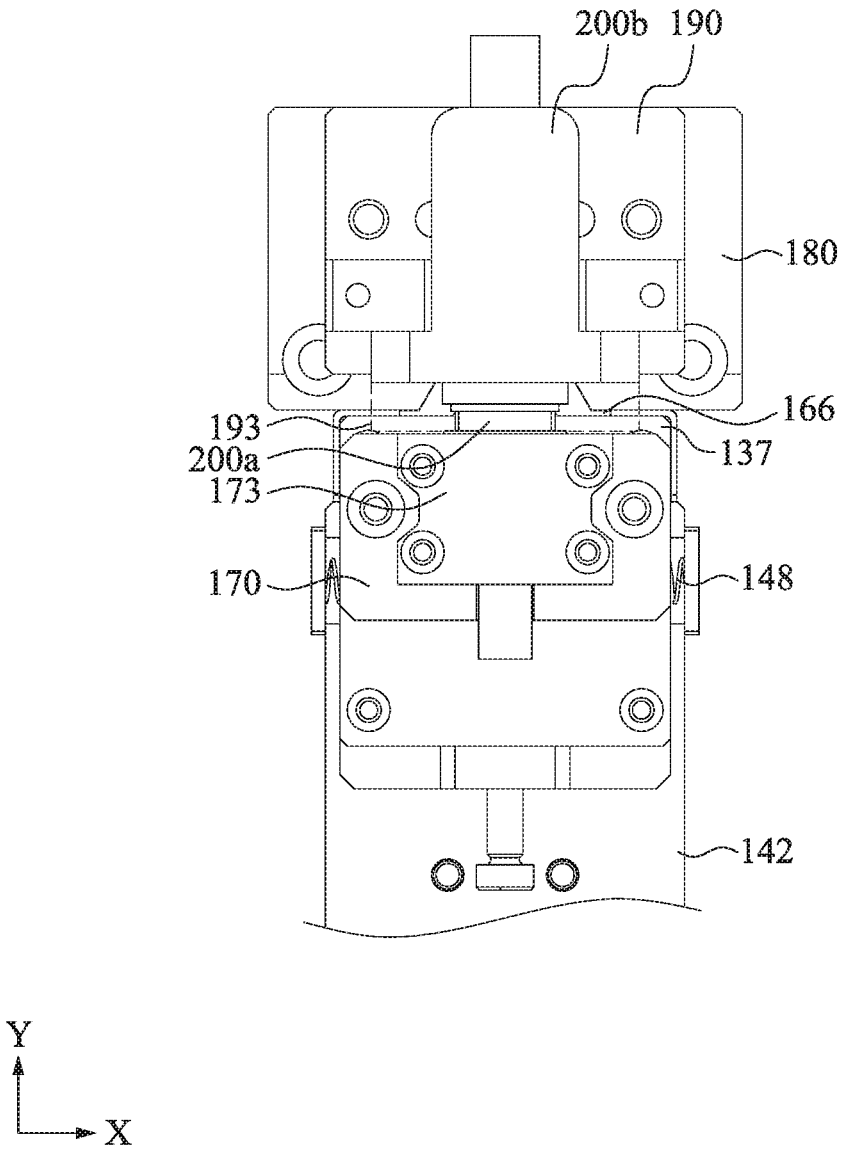

FIG. 10 follows FIG. 9A. After the first connector 200*a* is aligned with the second connector 200*b*, the first connector 200*a* is plugged into the second connector 200*b*. In detail, please refer to FIG. 10 and FIG. 6C together. The drive member 131 of the cylinder module 125 keeps pushing the first connector 200*a* to approach the second connector 200*b* along the Y direction. The protruding member 166 of the first position guide block 160 has been in contact with the second position guide block 180, so that the drive member 131 of the cylinder module 125 may make the second spring 158 abutting on the support plate 154 compressed. Accordingly, the first position guide block 160 may be gradually covered by the housing 137 of the guide buffer module 135 until the protruding member 166 of the first position guide block 160 is partly embedded into the housing 137. The drive member 131 stops driving and the protruding member 166 of the first position guide block 160 keeps in contact with the housing 137. More specifically, please refer to FIG. 3 together. The second connector 200*b* is further connected with the joint guide groove 193. The joint guide groove 193 further has a joint guide slope 194 next to the second connector 200*b*. Accordingly, in FIG. 10, the first connector 200*a* essentially enters the joint guide groove 193 first, and if there are some misalignments on the fine positioning, the first connector 200*a* may first come into contact with the joint guide slope 194, and the joint guide slope 194 may automatically and flexibly guide the first connector 200*a* into the second connector 200*b* to allow the first connector 200*a* to be plugged into the second connector 200*b*. The foregoing automatic guide is completed via the first springs 148 and the second spring 158 of the guide buffer module 135, so that when the first connector 200*a* comes into contact with the joint guide slope 194, the first connector 200*a* may not be greatly damaged. Via the joint guide slope 194 of the joint guide groove 193, the first connector 200*a* completes the flexible fine positioning in the third step thus to be precisely plugged into the second connector 200*b*.

In the present disclosure, the first connector 200*a* is aligned with the second connector 200*b* by the connector mounting mechanism 100 in the three steps including the first step of rough positioning (via the base 110), the second step of guide positioning (via the guide buffer module 135 and the first position guide block 160), and the third step of fine positioning (via the joint guide slope 194 of the joint guide groove 193), so that the first connector 200*a* is aligned with and plugged into the second connector 200*b*. In this implementation, the positioning precision of the guide positioning in the second step is higher than that of the rough positioning in the first step. In addition, the positioning precision of the fine positioning in the third step is higher than that of the guide positioning in the second step. The positioning precision herein refers to differences along the X direction and the Z direction, respectively, between the first connector 200*a* and the second connector 100*b* after a step of positioning procedure is completed. The less the difference is, the higher the positioning precision is.

To sum up, the connector mounting mechanism according to the embodiments of the present disclosure can plug the first connector into the second connector automatically and flexibly. The first connector can be roughly positioned to the second connector via the base, and the position of the first connector can be finely adjusted and guided to be aligned with the second connector via the contact between the first guide slope of the first position guide block and the second guide slope of the second position guide block. The first position guide block is movably received in a buffer guide mechanism via the first rail assembly and the second rail assembly, and the first rail assembly and the second rail assembly are provided with corresponding springs and linear rails, respectively, so that the fine adjustment and guide are automatic and flexible. After the positioning in the foregoing steps, the first connector can be aligned with the second connector precisely. Accordingly, in the present disclosure, the first connector can be plugged into the second connector normally and smoothly without additional processing on the first connector. However, in some actual implementations, the first connector and the second connector may be two joints respectively corresponding to the HDMI. However, the present disclosure is not limited thereto, and a tolerance of the two joints of the HDMI is on a level of one hundredth of a millimeter. The connector mounting mechanism according to the embodiment of the present disclosure plugs the first connector into the second connector, so that the results of the corresponding tests of two required connectors can be more accurate and reasonable.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector mounting mechanism configured to plug a first connector into a second connector, comprising:

a base;

a power module disposed on the base;

a guide buffer module connected with the power module;

a first position guide block connected with the power module and movably received in the guide buffer module, wherein the first position guide block has a first guide slope;

a first joint guide block disposed on the guide buffer module and connected with the power module, wherein the first joint guide block is configured to fix the first connector;

a second position guide block having a second guide slope; and a second joint guide block disposed at the second position guide block and configured to fix the second connector, wherein after the base moves to a preset position, the power module drives the guide buffer module to move so as to drive the first position guide block and the first joint guide block to move, and via the guide of the first guide slope and the second guide slope and the adjustment of the guide buffer module, the first position guide block is guided into the second position guide block, and in this case, the power module drives the first joint guide block to be plugged into the second joint guide block so as to allow the first connector to be plugged into the second connector.

2. The connector mounting mechanism according to claim 1, wherein the power module is a cylinder module.

3. The connector mounting mechanism according to claim 1, wherein the base comprises a first axial positioning mechanism, a second axial positioning mechanism, and a third axial positioning mechanism, and the first axial positioning mechanism, the second axial positioning mechanism, and the third axial positioning mechanism are perpendicular to and mechanically connected with each other.

4. The connector mounting mechanism according to claim 1, wherein the guide buffer module comprises a first rail assembly and a second rail assembly, and sliding directions of the first rail assembly and the second rail assembly are perpendicular to each other.

5. The connector mounting mechanism according to claim 4, wherein the second rail assembly is connected with the first rail assembly, and the first position guide block is connected with the second rail assembly.

6. The connector mounting mechanism according to claim 4, wherein the first rail assembly comprises a first linear rail and a group of first springs, the second rail assembly comprises a second linear rail and a second spring, the second rail assembly is movably disposed on the first linear rail via the group of first springs, and the first position guide block is movably disposed on the second linear rail via the second spring.

7. The connector mounting mechanism according to claim 6, wherein the first rail assembly further comprises a first rail platform, the second rail assembly further comprises a second rail platform and a support plate protruding from the second rail platform, the first linear rail is located on the first rail platform, the second rail platform is connected with the group of first springs thus to be movably disposed on the first linear rail, and the second linear rail is located on the second rail platform.

8. The connector mounting mechanism according to claim 7, wherein the second spring is connected with the first position guide block and the support plate.

9. The connector mounting mechanism according to claim 8, wherein the second rail assembly further comprises a slider, and the second spring is disposed on the slider.

10. The connector mounting mechanism according to claim 1, wherein the guide buffer module has a housing disposed on the first position guide block and has an opening, the first joint guide block is disposed on the housing, the first position guide block protrudes from the opening to expose the first guide slope, and the first position guide block has a freedom degree of movement along a direction of the opening.

11. The connector mounting mechanism according to claim 1, wherein the first joint guide block has a groove and a first joint fixing block, and the first connector is received in the groove, and the first joint fixing block covers the first connector, so that the first connector is fixedly received in the first joint guide block.

12. The connector mounting mechanism according to claim 1, wherein the second joint guide block has a joint guide groove having a joint guide slope and connected with the second connector, and the joint guide slope is next to the second connector.

13. The connector mounting mechanism according to claim 1, wherein when the power module drives the first position guide block to be guided into the second position guide block, the first guide slope is partly in contact with and attached to the second guide slope.

* * * * *